US005990919A

United States Patent [19]

Bobb et al.

[11] Patent Number: 5,990,919

[45] Date of Patent: Nov. 23, 1999

[54] SINGLE TRACK OF METERING MARKS ON THERMAL PRINTER MEDIA

[75] Inventors: Mark A. Bobb; Daniel C. Maslanka; Keith A. Hadley, all of Rochester, N.Y.

[73] Assignee: Eastman Kodak Company, Rochester, N.Y.

[21] Appl. No.: 09/028,739

[22] Filed: Feb. 24, 1998

Related U.S. Application Data

[62] Division of application No. 08/371,943, Jan. 12, 1995.

[51] Int. Cl.[6] ..... B41J 31/05

[52] U.S. Cl. ..... 347/217

[58] Field of Search ..... 347/217; 400/237, 400/240, 240.3, 240.4

[56] References Cited

U.S. PATENT DOCUMENTS

| | | | |
|---|---|---|---|
| 4,642,655 | 2/1987 | Sparer et al. | 346/76 |
| 5,292,709 | 3/1994 | Sakamoto | 503/227 |

FOREIGN PATENT DOCUMENTS

| | | |
|---|---|---|
| 2210585 | 6/1989 | United Kingdom . |
| 2228449A | 8/1990 | United Kingdom . |

*Primary Examiner*—Huan Tran
*Attorney, Agent, or Firm*—Walter A. Stevens

[57] ABSTRACT

A thermal dye printer media element for use in a thermal printer includes sequential color patches which form multiple color groups located along a length of the element. Metering marks are provided repetitively along the length of the element for measurement of distances along the element. The spacing between successive pairs of the metering marks may be uniform, change in a linear fashion, or change in a nonlinear fashion. The metering marks may be optically or magnetically detectable. The first and second metering mark sequences may be essentially the same. Alternatively, the first and second metering mark sub-sequences may be different. The start of a metering mark sequence may be aligned with an edge of a color patch, or may be offset from an edge of a color patch. A third sequence of metering marks may be provided for a third color patch, wherein said third metering mark sequence is different from said first sequence.

6 Claims, 14 Drawing Sheets

SINGLE TRACK OF METERING MARKS ON THERMAL PRINTER MEDIA

CROSS-REFERENCE TO RELATED APPLICATIONS

This is a divisional of application Ser. No. 08/371,943, file Jan. 12, 1995.

BACKGROUND OF THE INVENTION

1. Technical Field

The present invention relates to thermal printers, and more particularly to precisely measuring the movement of media along a media transport path.

2. Background Art

Color thermal printers form a color print by successively printing with a dye donor onto a dye receiver, where the dye donor includes a repeating series of color patches. The print head of a thermal printer commonly provides a print line of elements that can be individually heated. Print heads can be any one of several forms including resistive element, resistive ribbon and laser print heads.

FIG. 1 shows a typical printing operation where a printer 10 includes a print head 12 and a platen 14. A dye donor 16 and a dye receiver 18 are sandwiched between the print head and the platen. An image is printed by selectively heating individual elements of print head 12 to transfer a first dye to dye receiver 18. The dye receiver is then repositioned to receive a second color of the image, and the dye donor is positioned to provide a second dye color. These steps are repeated until all colors of the image are printed and the completed print is ejected from printer 10.

The alignment of each dye donor color patch to the print head is important to achieve a quality print. Alignment refers to locating two independent components in specific positions with respect to each other. There are at least two approaches for aligning the dye donor color patches to the print head. One such approach is shown in U.S. Reissue Pat. No. RE 33,260, and uses color sensors to detect the color of a color patch and to emit a distinctive color-type signal when an edge of a color patch passes the color sensors. The accuracy of positioning a color patch to the print head is directly related to the location of the color sensors with respect to the print line of the print head. Putting the color sensors at the print line requires locating the color sensors off to one side of the print head, which in turn requires wider dye donor material, as depicted in FIG. 2. This method uses dye donor 16 inefficiently because of the additional width which cannot be used for making a print, resulting in increased cost per print for the user.

Locating the color sensors upstream or downstream of the print line avoids the need for wider dye donor. In FIG. 3, color sensors 20 are located downstream of print head 12. Thus, when the leading edge of a color patch is sensed, the print line is located within the color patch. If dye donor 16 is not moved after the leading edge of the color patch is sensed, the amount of dye patch between the print line and the color sensors is unused. This presents a problem due to the distance between color sensors 20 and the print line of print head 12. Dye donor 16 is again wasted unless it is rewound prior to printing. This undesirable waste of dye donor 16 again increases the cost per print for the user.

The dye donor could be rewound after the leading edge is sensed to reduce the unused portion of each color patch. This method has two disadvantages. First, an additional motor and media transport component would be needed to drive the donor in the reverse direction, significantly increasing the cost and complexity of the printer. Second, because the accuracy with which the dye donor can be rewound is uncertain, the dye donor must be rewound an amount less than the separation of the color sensors to the print line to insure that the print line remains within the color patch. This requires accurate metering of the donor movement. Metering in this case is the measurement of distance between two locations. Accurate rewinding of dye donor 16 requires a complex bidirectional donor transport system and an accurate metering method to measure how far dye donor 16 has been moved. This metering can be provided by adding an encoder or timing wheel to either the donor supply spool or the donor take up spool. One example of this method is shown in FIG. 4, where an encoder 26 is attached to a dye donor supply spool 22. As supply spool 22 rotates, an encoder sensor 28 responds to the motion of encoder 26 and outputs appropriate signals to determine how far the donor 16 has moved.

These methods suffer from two disadvantages. First, the amount of dye donor 16 movement for one rotation of spool 22 depends upon the donor diameter. In other words, more media moves for one revolution of a new donor supply spool 22 than for a nearly spent supply spool 22. It is difficult to know the diameter of donor on spool 22 without yet more sophisticated and expensive components. Thus, accurate measurement of dye donor 16 movement is not provided. An additional disadvantage of these two methods is that both add significantly to the cost and complexity of the printer hardware.

The color sensors could also be positioned upstream of the print line. This solution eliminates the need for rewinding the donor after the edge of the color patch is sensed. However, it requires accurate metering of the donor some amount greater than the separation of the color sensors from the print line, to insure the print line is within the color patch for printing. Hence, this method also has the disadvantage of requiring additional expensive components for its implementation.

Whether the color sensors are located upstream or downstream of the print line, the color patch size must be larger than the maximum size image to allow for color patch alignment tolerances. The patch size increase is related to the accuracy (or inaccuracy) of donor movement and can be a significant percentage of the actual printed image size. This results in inefficient usage of donor, caused by an inability to move media a precise distance, and resulting in an increased cost per print.

The second major approach for aligning a color patch to a print head utilizes a detectable mark provided on the dye donor to indicate the start of a color group or color patch. A detection mark is a symbol or collection of a small number of marks, such as a bar code, which conveys information. Detection marks may be produced using optical, magnetic, electrical, tactile or any other method that is easily readable. One example of this method is shown by Maeyama et al. in U.S. Pat. No. 4,496,955.

Maeyama et al. show a dye donor with two series of detection marks. The first series of detection marks identifies the beginning of a color group and the second series identifies the beginning of each color patch. Two detection mark sensors, one for each series of marks, are located downstream of the print line. In the operation of Maeyama et al., the donor is fast forwarded at the completion of printing a color patch. When a detection mark is sensed, positive drive tension is removed from the donor, after which the donor continues to coast in a forward direction. Some time later, when a mechanical sensor is activated by the platen movement, the signals from an encoder attached to the platen are counted until the platen has moved to the first printing position. The detection marks in Maeyama et al. provide dye donor velocity control signals, and are not directly used to align color patches to the print line or to measure the amount of donor movement. The accuracy of this method may be affected by lifting of the print head when the dye donor advances between color patches. If the print head in Maeyama et al. remains pressed against the platen during the printing of all color patches, it may be assumed that the motion of the platen is closely related to the motion of the donor. Dye donor often is distorted by the heating it receives during printing, thus this donor-platen motion relationship may not always be equal. Other thermal printers release the pressure of the print head against the platen between printing with individual color patches. When this is done, the relationship between platen movement and dye donor movement is lost. Hence accurate dye donor movement would not be provided with the Maeyama et al. implementation.

Ito et al. U.S. Pat. No. 4,720,480 describes numerous ways to provide a detection mark on dye donor and dye receiver. The examples presented by Ito et al. are directed to a single detection mark for each color patch or region, located near the beginning of a color patch or color group. This detection mark provides information confirming the region of a desired color in a color dye donor, confirming residual number of sheets in a monochromatic dye donor, or otherwise confirming the front or back, direction, grade, etc. of the dye donor. No indication is given that any of these detection mark forms are used for accurately measuring the movement of the dye donor. Ito et al. also describe providing a detection mark on dye receiver to supply the same types of information as the dye donor. Again, these detection mark forms are not used for accurately measuring the movement of the dye receiver.

The measurement of dye donor or dye receiver position rather than their movement is inherent in the detection mark concepts decribed thus far. Other efforts have been made to provide precise movement of dye donor or dye receiver, sometimes known as metering.

Shimizu et al. describe in U.S. Pat. No. 5,037,218 a method that combines a detection mark on dye donor with several sensors and encoders to provide accurate metering of dye donor. The detection mark sensed by a first sensor identifies the dye donor type and its sequence of color patches. A signal generator mechanically linked to the platen produces a first set of signals related to the print line spacing of an image. A second sensor generates a second set of signals related to the turning of an encoder attached to the dye donor supply spool. After the detection mark is sensed, the printer compares the first and second sets of signals to determine how much of the dye donor remains on the supply spool. When the first color patch has been printed and more than half of the dye donor is on the supply spool, the dye donor is moved to the next color patch by driving the supply spool for one revolution. However, when less than half of the dye donor is on the supply spool, the dye donor is moved to the next color patch by driving the supply spool for two revolutions. The Shimizu et al. metering method approximately positions the dye donor for all color patches, and does not provide accurate measurement of dye donor movement or positioning of the print line in the color patch. Larger color patch sizes are still required to allow for variation of the printed image area within a given color patch. As with the other encoder methods discussed before, Shimizu et al. require many more components in a significantly more complex hardware implementation than is necessary or desirable. All of these difficulties increase the complexity and cost of the printer and the per print cost to the user, without providing accurate metering or dye donor alignment.

Finally, Takanashi et al. describe a dye receiver metering method in U.S. Pat. No. 4,590,490. The dye donor, dye receiver and print head in Takanashi et al. are significantly larger than the final printed image. When the first color patch information in printed onto the dye receiver, synchronization marks are printed along a border of the dye receiver, outside the printed image area. The Takanashi et al. implementation requires a print head which is significantly larger than the printed image, or, alternatively, not all of the print head is utilized to print the image. Synchronization mark sensors are located at the print line, further increasing the overall size of the dye donor and dye receiver necessary for this method to function. The print head design is much more complex than common designs and inefficiently uses the printing elements available on the print head. The synchronization mark sensors at the end of the print head have the same problems as decribed in FIG. 2 earlier. The Takanashi et al. method requires significantly larger dye donor and dye receiver, wasting a significant proportion of both and requiring the user to remove the unwanted synchronization marks after printing is complete. Takanashi et al. use synchronization marks to indicate where the initial color patch print lines were printed. These marks, applied by the print head during the printing operation, are not used to measure the movement of the dye receiver. All of the problems mentioned here significantly increase the complexity and cost of the printer, difficulty for the user to make a print, and increases the cost per print to the user. None of these are beneficial.

None of the preceeding prior art methods provide accurate movement or alignment of the dye donor or dye receiver in the printer. All require more complex hardware and less efficient utilization of the dye donor or dye receiver. These methods undesirably impact the cost of the printer and the cost per print to the user.

DISCLOSURE OF THE INVENTION

It is an object of the present invention to provide accurate media movement and position control. This object is accomplished in part by providing media with metering marks which, in addition to position or movement information, convey information about the media to the printer.

The present invention has the following advantages: it allows accurate measurement of distances along the dye donor or dye receiver, it permits precision alignment of dye donor or dye receiver to the print head, it eliminates the need for additional metering hardware such as encoders, a metering mark sequence can be designed to include information unique to media, variations in metering marks can convey to the printer information such as start-of-patch or start-of-color-group, it reduces the number and complexity of media detectors required in printer, it cannot be confused if a user opens printer and replaces media since the metering marks are on the media, and the marking method can be employed with optical, magnetic, electrical, tactile or other means.

According to the present invention, a thermal dye printer media element for use in a thermal printer, includes sequential color patches which form multiple color groups located along a length of the element. Metering marks are provided repetitively along the length of the element for measurement of distances along the element. The spacing between successive pairs of the metering marks may be uniform, change in a linear fashion, or change in a nonlinear fashion. The metering marks may be optically or magnetically detectable.

The first and second metering mark sequences may be essentially the same. Alternatively, the first and second metering mark sub-sequences may be different. The start of a metering mark sequence may be aligned with an edge of a color patch, or may be offset from an edge of a color patch. A third sequence of metering marks may be provided for a third color patch, wherein said third metering mark sequence is different from said first sequence.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art. While the invention is described below in the environment of a thermal printer, it will be noted that the invention can be used with other types of printers.

Single Metering Mark Track

Figure 1:
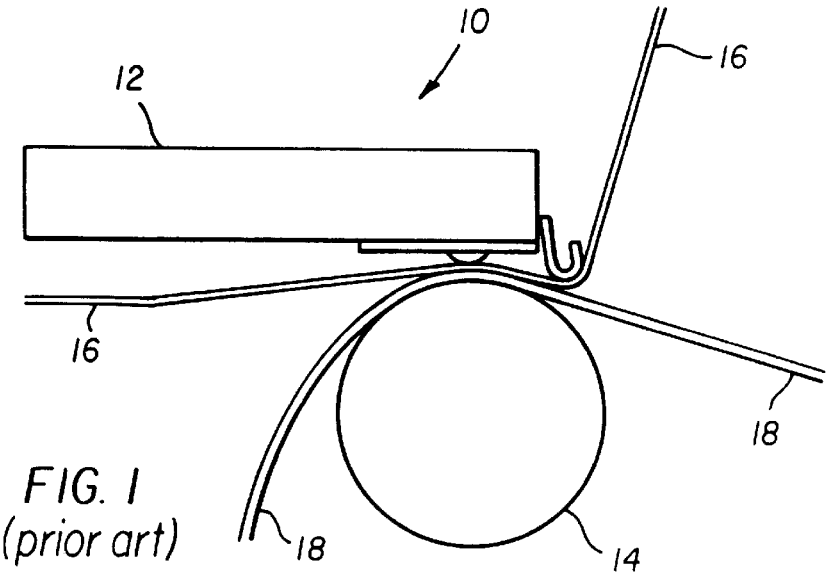
FIG. 1 (prior art)
FIG. 1 shows a cross sectional view of a thermal printer according to the prior art, including a print head, platen, dye donor and dye receiver.
Figure 2:
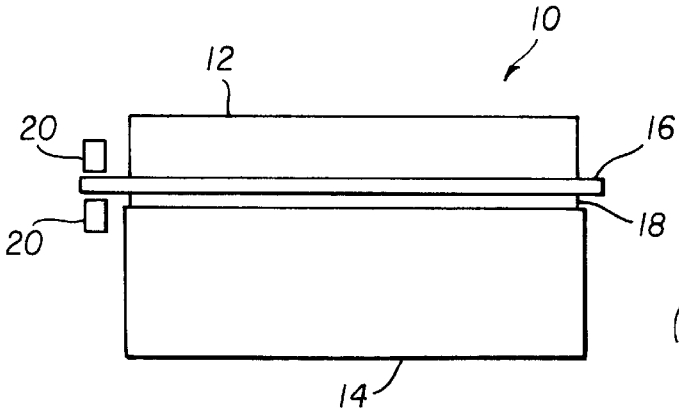
FIG. 2 (prior art)
FIG. 2 shows color sensors located at the print line of a print head according to the prior art, demonstrating this method's need for wider dye donor.
Figure 3:
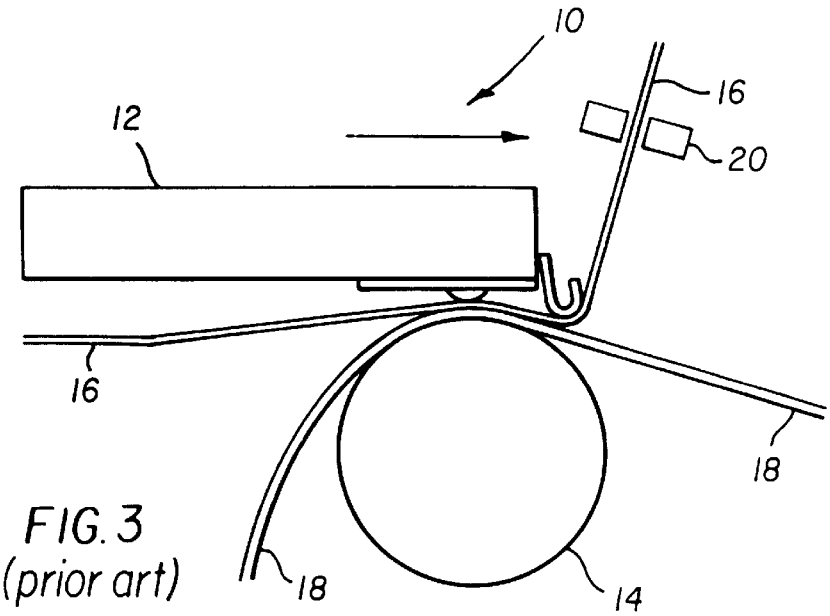
FIG. 3 (prior art)
FIG. 3 shows color sensors located downstream from the print line of a print head according to the prior art.
Figure 4:
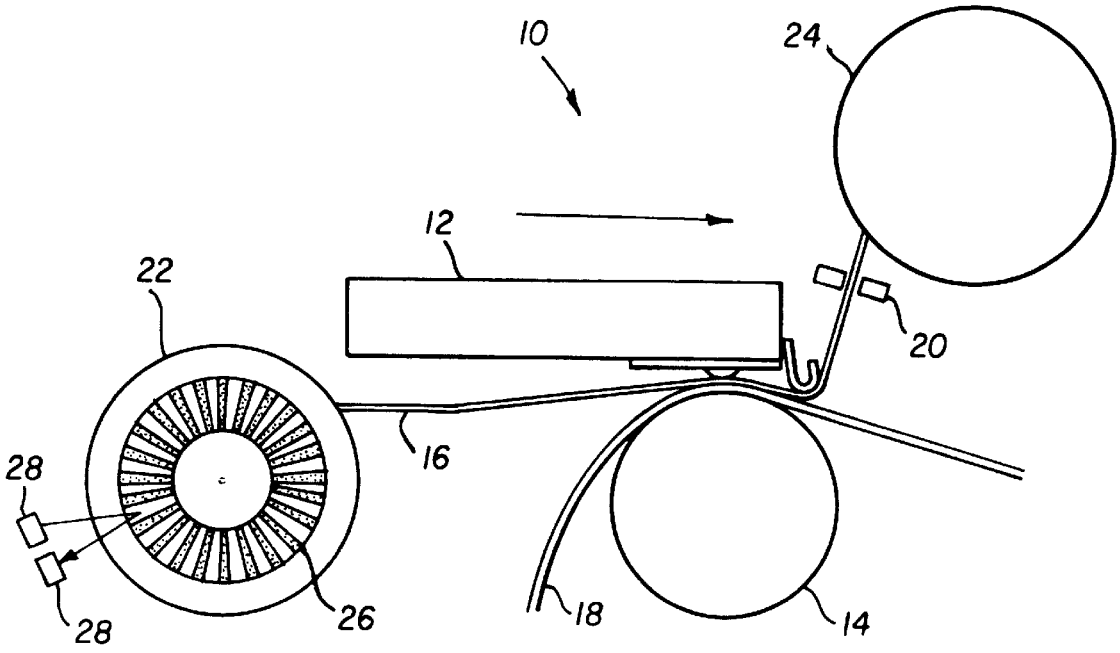
FIG. 4 (prior art)
FIG. 4 shows a thermal printer with an encoder on a donor spool and associated encoder sensors according to the prior art.
Figure 5A:
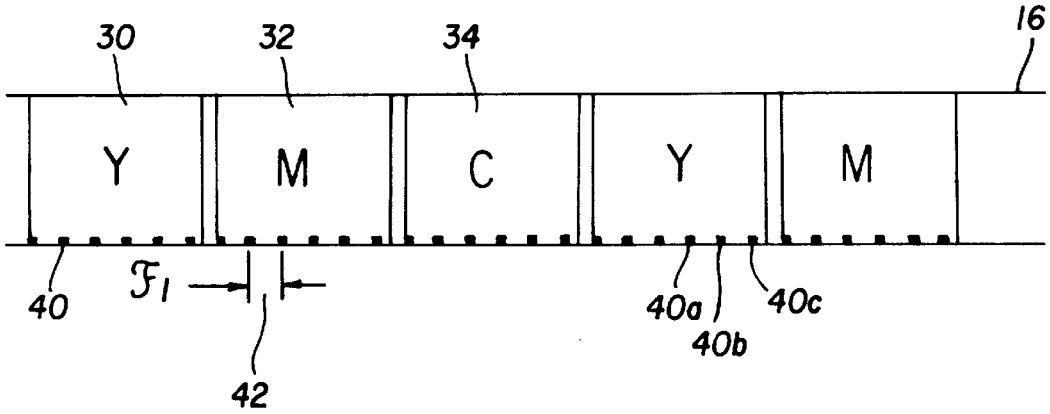
FIGS. 5(*a*) and 5(*b*) show a dye donor with a single track of metering marks, where the spacing of the marks is uniform.
Figure 5B:
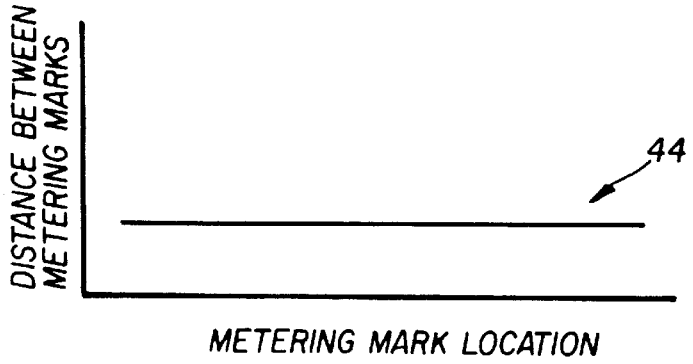

In the embodiment of the present invention shown in FIG. 5(*a*), a dye donor 16 includes a repetitive series of color patches, such as, for example yellow 30, magenta 32, and cyan 34. A single track of metering marks 40 is provided. The distance between a first pair 40*a*, 40*b* of metering marks 40 is the same as the spacing between an adjacent pair 40*b*, 40*c* of metering marks. Thus the spacing $F_1$ between metering marks at 42 is uniform. FIG. 5(*b*) shows a plot 44 of the distance between metering marks and the metering mark location. Since the spacing in this example is uniform, the plot line 44 has zero slope. Now, if a unique spacing between metering marks is used for each different type of dye donor 16, then the metering mark can convey donor type information in addition to providing accurate distance measurement capability.

Figure 6A:
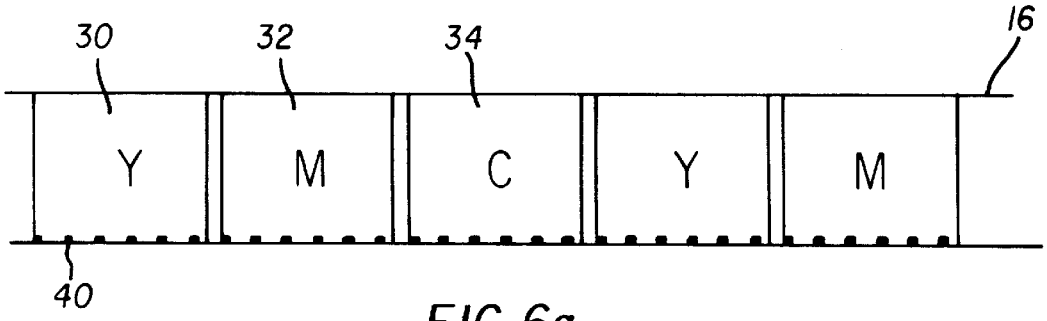
FIGS. 6(*a*) and 6(*b*) show metering marks on dye donor may overlap color patch areas or in a border area adjacent to a color patch, respectively.
Figure 6B:
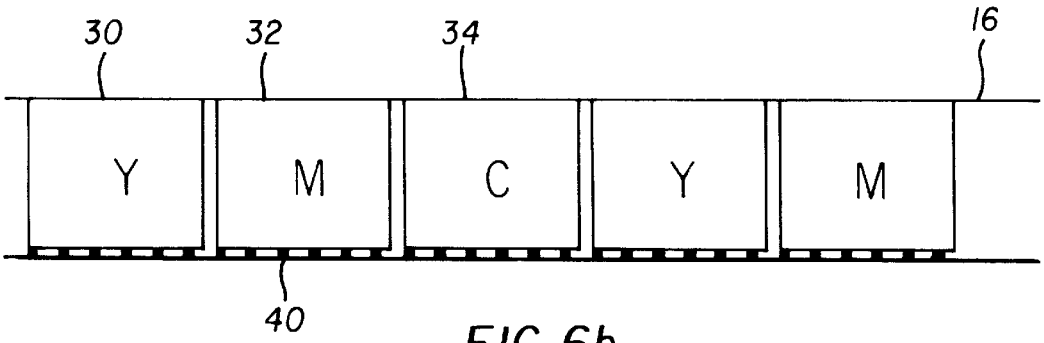
Figure 7:
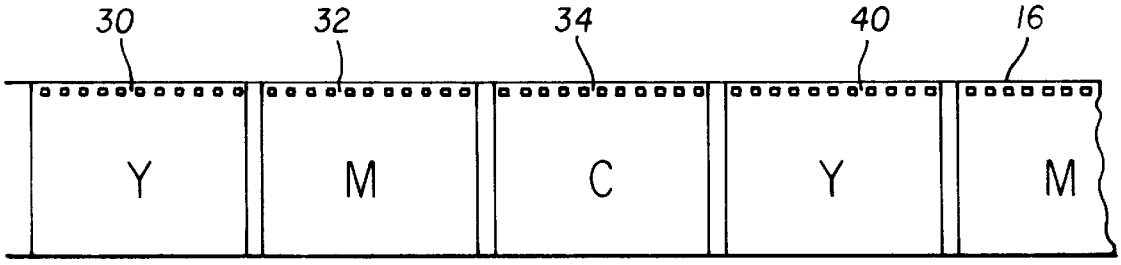
FIG. 7 shows metering marks provided by an absence of dye within a color patch.

Metering marks 40 may overlap color patches 30, 32, 34, of dye donor 16, as shown in FIG. 6(*a*), or they may be provided in a border adjacent to the color patches, as shown in FIG. 6(*b*). Metering marks 40 may also be provided by an absense of dye within color patches 30, 32, 34, as shown in FIG. 7. Metering marks may alternatively be formed by other methods known to those skilled in the art, including but not limited to optical, electrical, magnetic or physical marks.

Figure 8A:
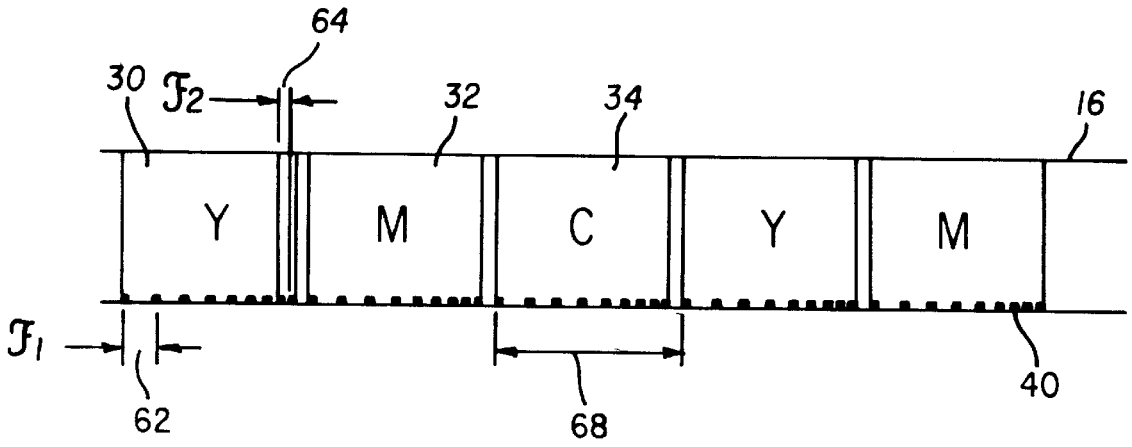
FIGS. 8(*a*) and 8(*b*) show a dye donor with a single track of metering marks including a pattern that repeats each patch length, where the spacing of the marks varies linearly.
Figure 8B:
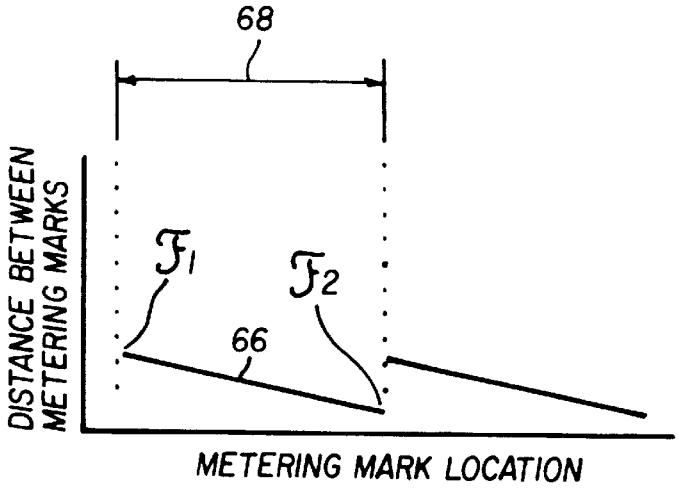

It is possible to provide non-uniform spacing between adjacent metering marks. FIG. 8(*a*) shows a dye donor 16 where at 62, the distance $F_1$ between a first pair of metering marks is different than the distance $F_2$ between a second pair of metering marks at 64. In this example, the distance between successive metering marks varies linearly. FIG. 8(*b*) shows a plot of the distance between metering marks and the metering mark location for this embodiment, confirming the linear spacing and slope. The sequence 68 of metering marks is repeated for each color patch. Note that when metering mark sequence 68 repeats, the change in metering mark spacing can signal some spatial information to the printer. If, as in this example, sequence 68 repeats for each color patch, the spacing change which occurs as sequence 68 repeats can be used to signal the beginning of a new color patch. Also, the slope of the metering mark sequence can be used to contain information. Unique slope values can be provided for various kinds of information relating to the dye donor, such as dye donor type, where the slope value can indicate which type of donor is present.

Figure 9A:
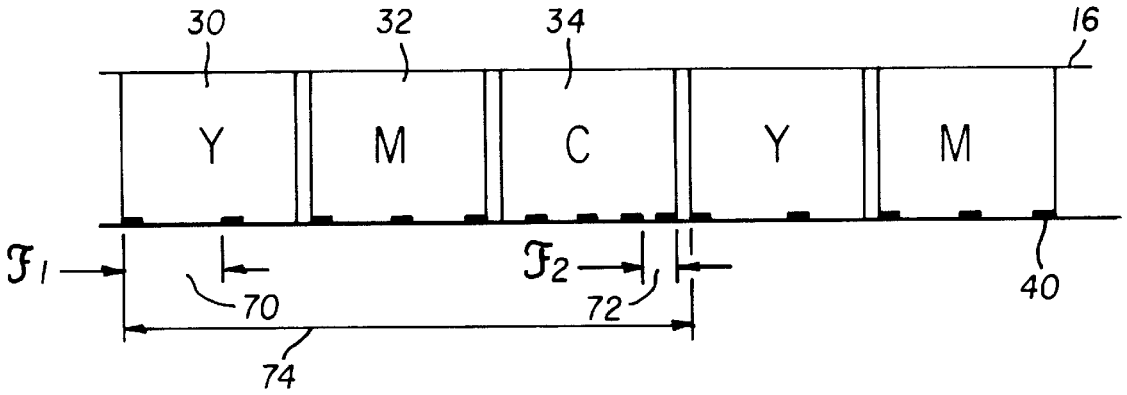
FIGS. 9(*a*) and 9(*b*) show a dye donor with a single track of metering marks including a pattern that repeats each color group length, where the spacing of the marks varies linearly.
Figure 9B:
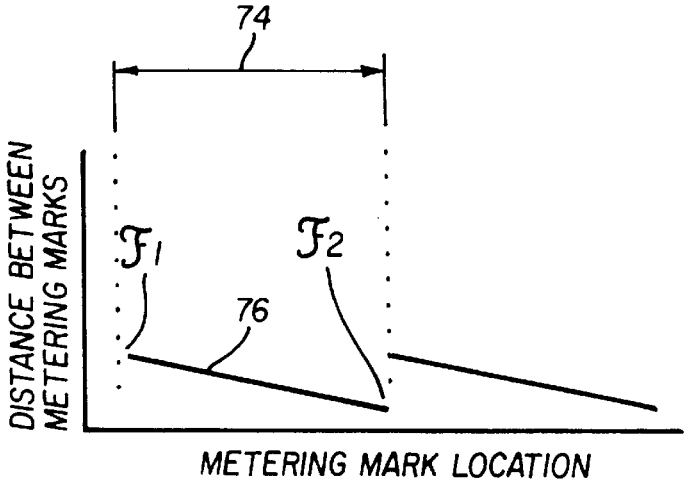

An alternative to this arrangement is to have the sequence of metering marks repeat for every color group, as shown in FIG. 9(*a*). In this example, a dye donor 16 has a single track of metering marks 40 wherein at 70, the distance $F_1$ between a first pair of metering marks is different than the distance $F_2$ between a second pair of metering marks at 72. As before, the distance between successive metering marks varies linearly. FIG. 9(*b*) shows a plot of the distance between metering marks and the metering mark location for this embodiment, confirming the linear spacing and slope. In this alternative, the sequence 74 of metering marks is repeated for each color group. Thus when the metering mark sequence 74 repeats, the beginning of a new color group is signalled.

Figure 10:
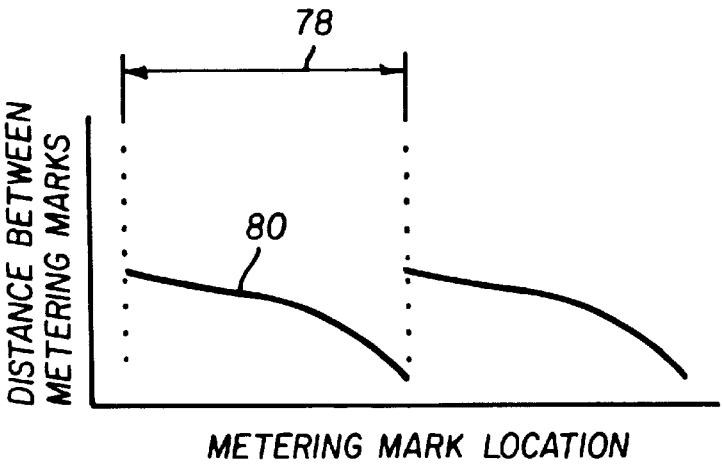
FIG. 10 shows a metering mark spacing which includes a pattern that repeats, where the spacing of the marks varies nonlinearly.

The distance between metering marks need not be uniform or linear. A metering mark can be designed with nonlinear spacing, as shown in FIG. 10. In this example, the sequence of metering marks 78 shows a nonlinear plot such as a parabola. Other nonlinear forms can also be used, such as but not limited to logarithmic, exponential, etc. Again, when the metering mark sequence repeats, information such as the beginning of a new color patch or color group may be signalled.

Figure 11:
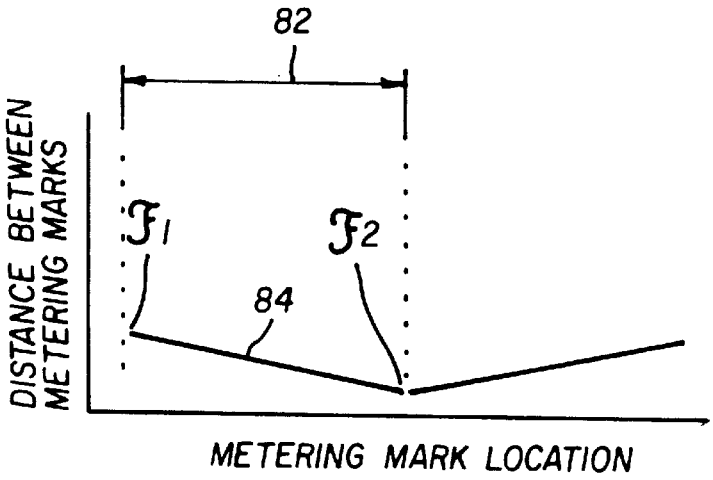
FIG. 11 shows a metering mark spacing which includes a repeating pattern in which the sequence of spacing between marks reverses for alternating patches or color groups.

Notice that the metering mark sequence repeats for each new cycle in FIGS. 8–10. It is also possible to have alternating metering mark sequences, as shown in FIG. 11. In this example, the form of a metering mark sequence 82 is linear with a negative slope as shown in a plot 84. The adjacent metering mark sequence has the same form but oppositely signed slope, in this case, positive. In this way, in addition to the slope of the metering mark sequence containing information, a change in the sign of the slope can indicate information about the dye donor such as start of color patch or start of color group.

Figure 12:
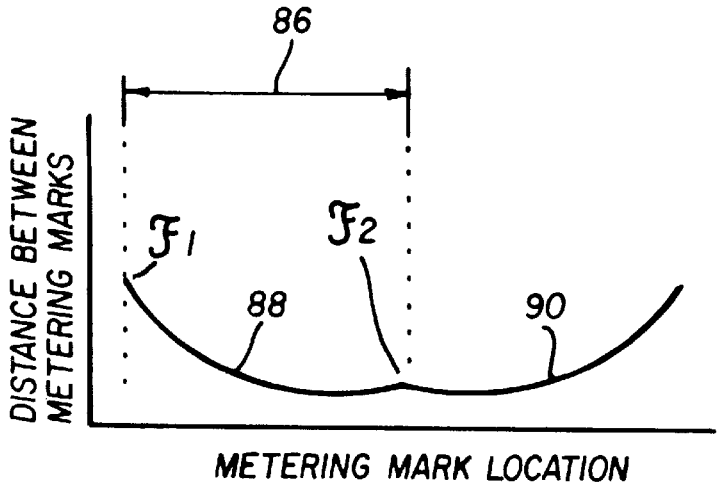
FIG. 12 shows a metering mark spacing similar to FIG. 11 except the spacing between marks is nonlinear.

FIG. 12 depicts yet another nonlinear metering mark sequence 86, which in this example is a portion of a sine or cosine curve. The adjacent sequence in this plot portrays the opposite sequence of spacings, which in this case is also the other half of the sine curve. This type of spacing provides the opportunity to use the phase of the metering mark spacing curves to convey information to the printer.

Figure 13A:
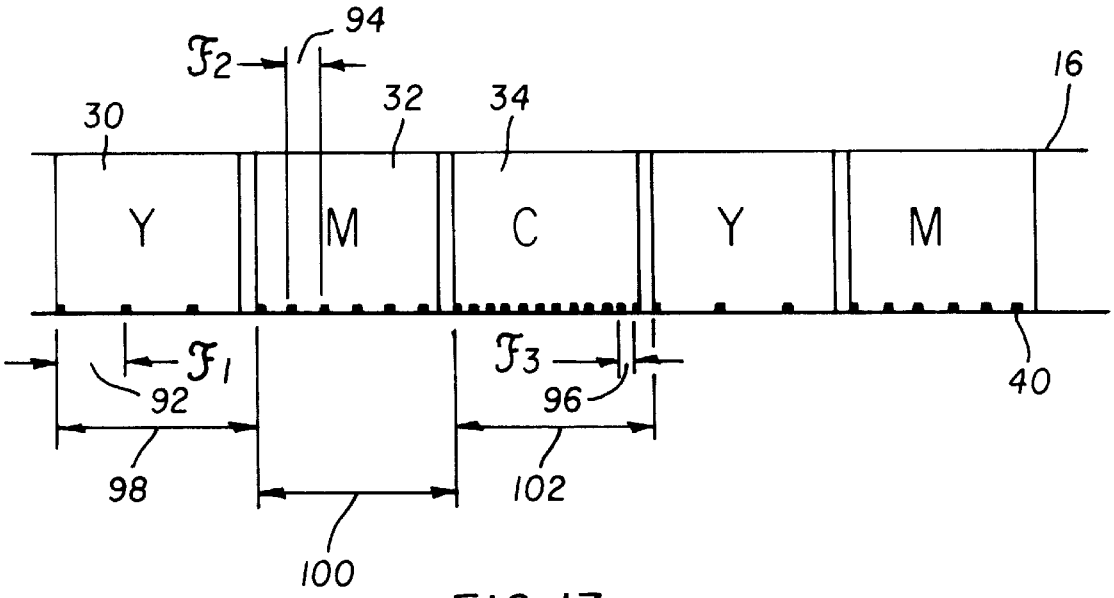
FIGS. 13(*a*) and 13(*b*) show a dye donor with a single track of metering marks including a distinct pattern of marks for each patch in a color group, such that the color group patterns repeat for each color group, and where the spacing of the marks for each patch varies linearly.
Figure 13B:
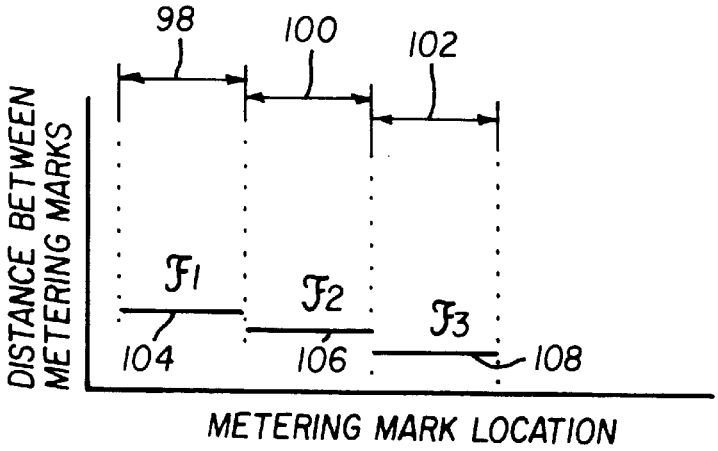

Yet another metering mark design has a different metering mark sequence for each color patch in a color group, as shown in FIG. 13(*a*). At 92, the distance $F_1$ between marks in a first metering mark sequence 98 is uniform. Similarly at 94, the distance $F_2$ between marks in a second metering mark sequence 100; and at 96, the distance $F_3$ between marks in a third metering mark sequence 102 are also uniform. The distances $F_1$, $F_2$, and $F_3$ are different from each other. The metering mark sequences 98, 100 and 102 could also be different from each other, although in this example they are all uniform as shown by the plot 104, 106 and 108 respectively in FIG. 13(*b*). Note that with this metering mark design, information could be conveyed using each unique sequence characteristic, such as for exmple sequence plot shape (linear, nonlinear, etc), spacing between marks, et cetera.

Figure 14A:
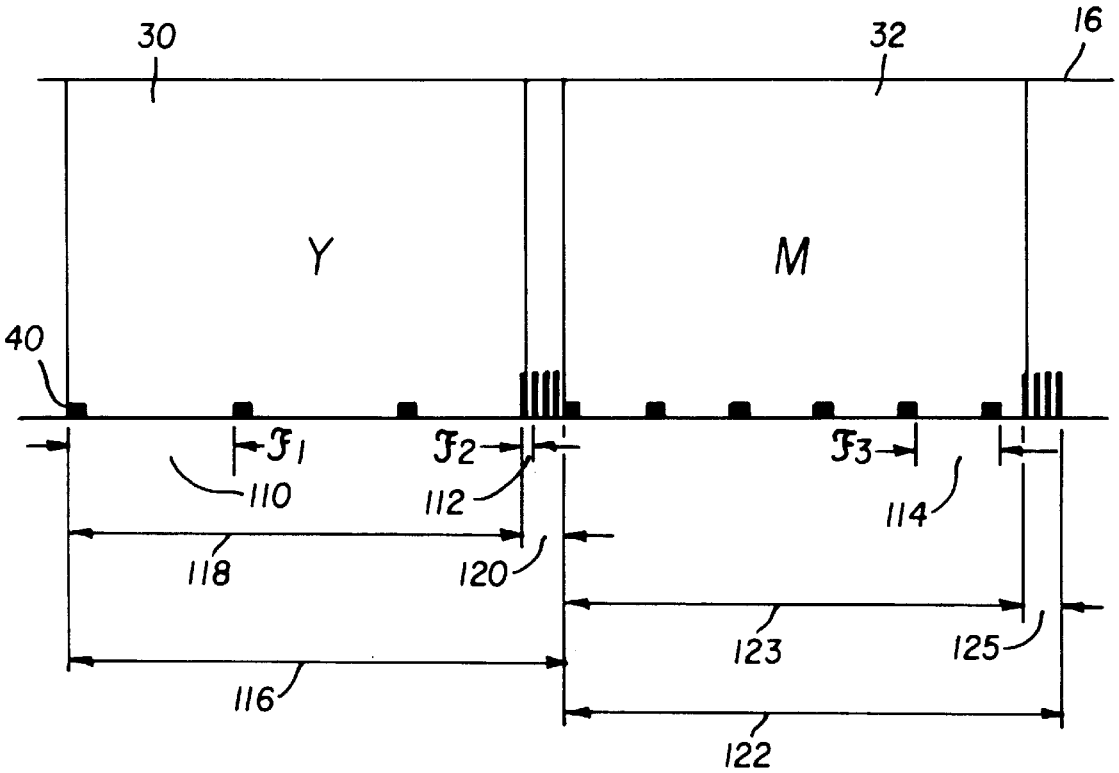
FIGS. 14(*a*) and 14(*b*) show a dye donor with a single track of metering marks, where each patch includes a distinct pattern formed by more than one sub-sequence of metering marks, where the spacing of the marks for each sequence or sub-sequence varies linearly.
Figure 14B:
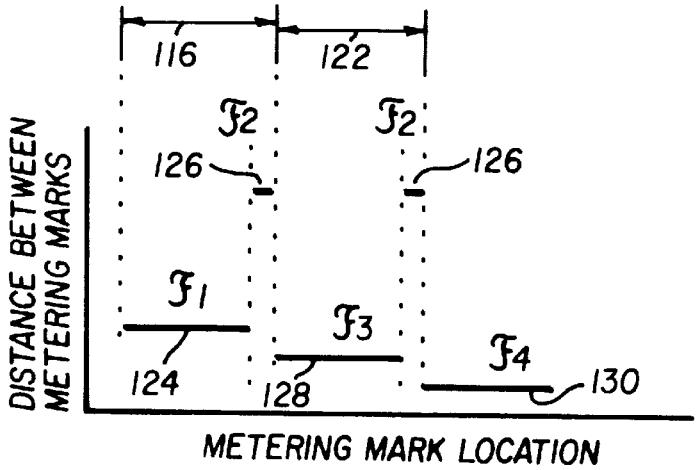

FIG. 14(*a*) portrays a metering mark sequence 116 which includes multiple sub-sequences of metering marks. In this case at 110, a first sub-sequence 118 of a first metering mark sequence with a distance between marks of $F_1$ and, at 112, a second sub-sequence 120 of the first metering mark sequence with a distance between marks Of $F_2$ combine to form a first metering mark sequence 116. Another metering mark sequence 122 is formed by combining a first sub-sequence 123 of a second metering mark sequence with, at 114, a distance between marks of $F_3$ and a second sub-sequence 125 of the second metering mark sequence with, at 112, a distance between marks of $F_2$. Although not required, this example shows the second sub-sequences 120, 125 with the same distance $F_2$ between marks. Using the same sub-sequence as a portion of each full sequence could be used to signal a position on the dye donor 16, for instance, the end of a color patch. FIG. 14(*b*) shows the plots for the first sub-sequence 124 and second sub-sequence 126 of the first metering mark sequence 116, and the first sub-sequence 128 and second sub-sequence 126 of the second metering mark sequence. A portion of a third metering mark sequence is also plotted 130.

Figure 15:
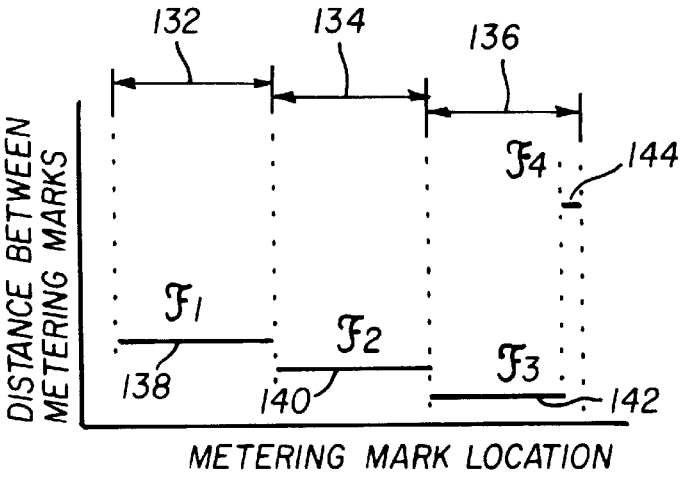
FIG. 15 shows a metering mark spacing which includes multiple spacing sequences between marks within a color group, and where at least one sequence includes more than one sub-sequence of metering marks.

Rather than identifying the end of each color patch, the metering mark can be designed to indicate the end of a color group. FIG. 15 shows a plot of the distance between metering marks where a first sequence 132 has a plot 138 and a second sequence 134 has a plot 140. A third metering mark sequence is composed of a first sub-sequence 142 and a second sub-sequence 144. The second sub-sequence 144 could indicate the end of the color group.

Figure 23:
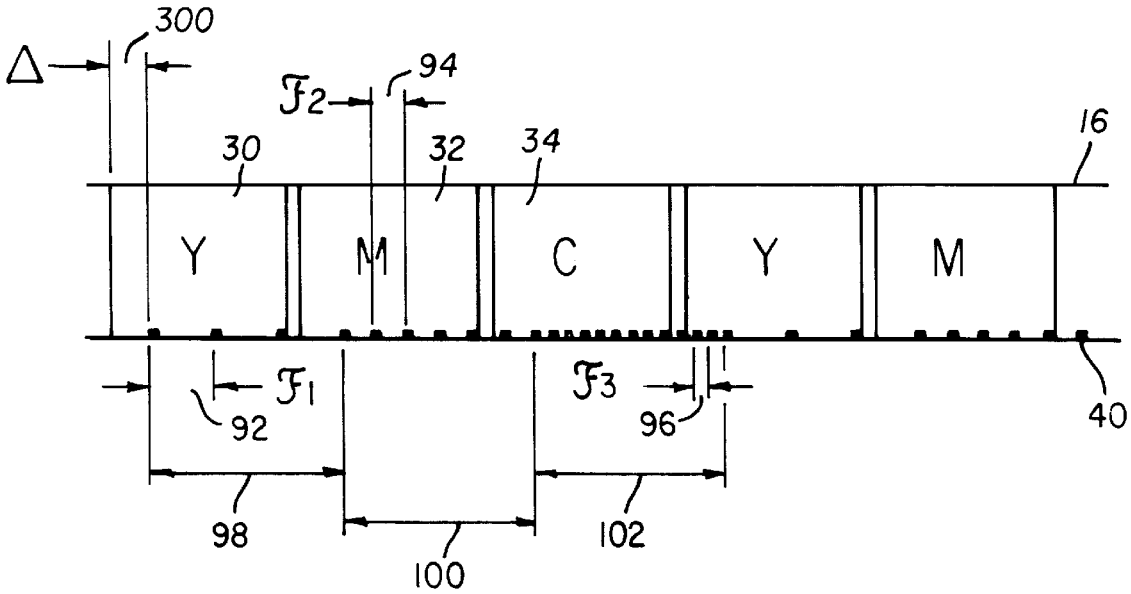
FIG. 23 shows a dye donor with a single offset metering mark track.

The preceeding examples describe metering marks with sequences that align to features on the dye donor such as the start or end of a color patch, or the start or end of a color group. However, some printer configurations may benefit from sequences which are offset from the color patches or color groups. For instance, a printer that locates the metering mark sensors upstream or downstream of the print line may benefit from metering mark sequences that begin or end at the sensor when then appropriate color patch is properly aligned to the print line of the print head. FIG. 23 shows one embodiment of a metering mark track offset from the start of the color patches. In this example, the start of the first metering mark sequence 98 is offset, at 300, a distance D in the upstream direction from the start of its associated color patch 30. Thus, when an upstream sensor detects the start of the first sequence, the associated color patch would be closely aligned to the print head.

A variation on the application of these sub-sequences is to use them to identify the start of printing, start of patch or start of color group. Yet other information or meanings could be assigned to these designs.

Mutilple Metering Mark Tracks

It is possible to achieve greater metering accuracy and convey additional information if more than one metering mark track is provided on the dye donor. For example, implementations using two metering tracks will next be discussed.

Figure 16A:
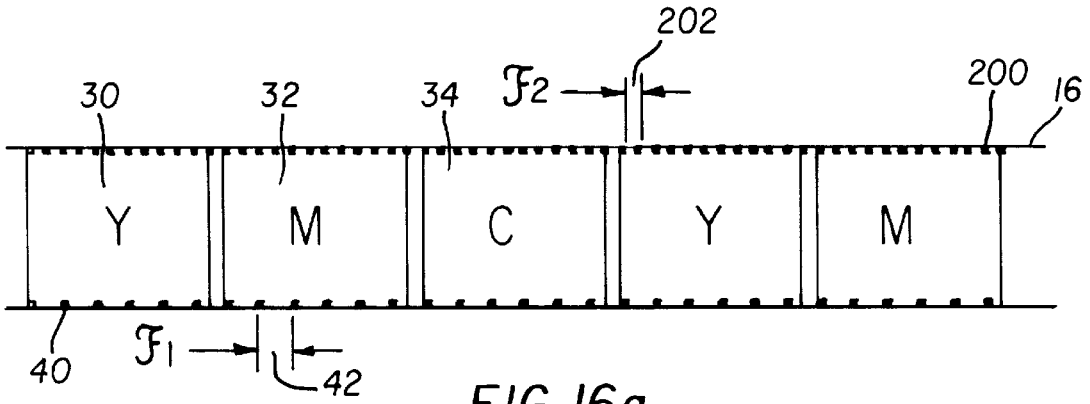
FIGS. 16(*a*) and 16(*b*) show a dye donor with two tracks of metering marks, each including a distinct pattern, where the spacing of the marks for each track varies linearly.
Figure 16B:
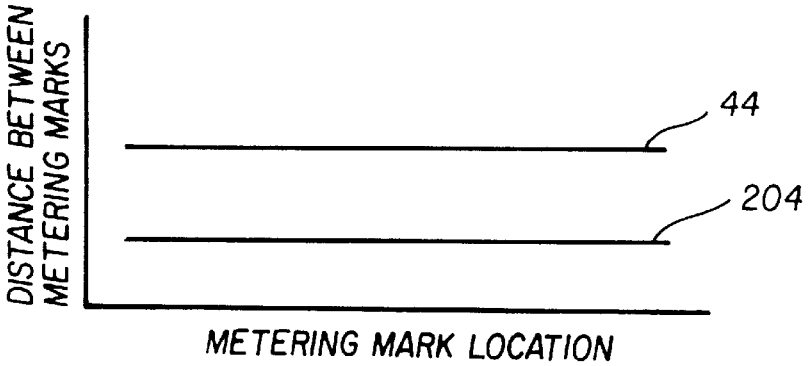
Figure 17A:
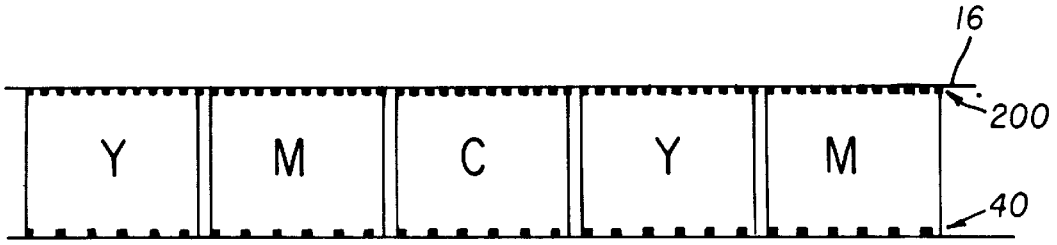
FIGS. 17(*a*) to 17(*e*) show a dye donor with two tracks of metering marks where: in 17(*a*) a track is located on each long edge of the dye donor overlapping color patch areas, in 17(*b*) both tracks are located separately on the same side of the dye donor, in 17(*c*) both tracks are located adjacent to one another and on the same side of the dye donor, in 17(*d*) a track is located on each long edge of the dye donor in a border adjacent to the patches, and in 17(*e*) both tracks are located adjacent to one another on the same side of the dye donor and in a border adjacent to the patches.
Figure 17B:
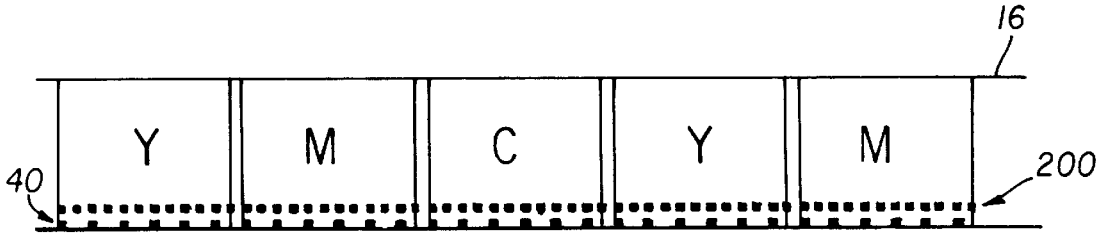
Figure 17C:
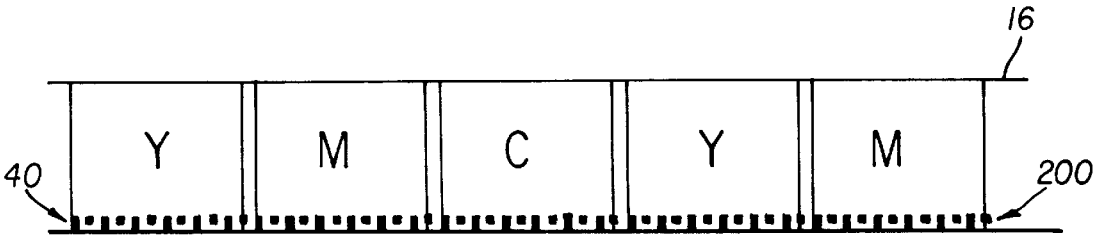
Figure 17D:
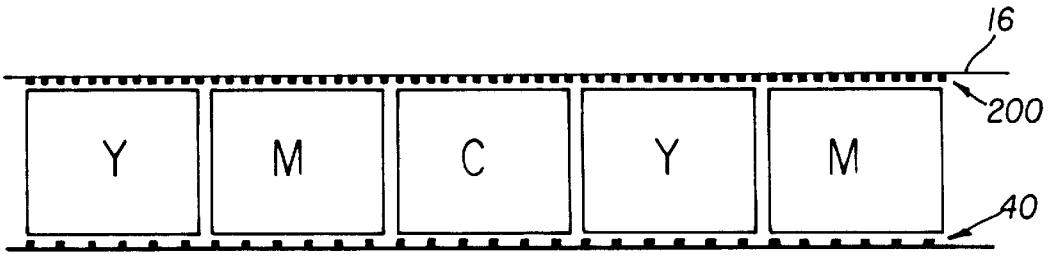
Figure 17E:
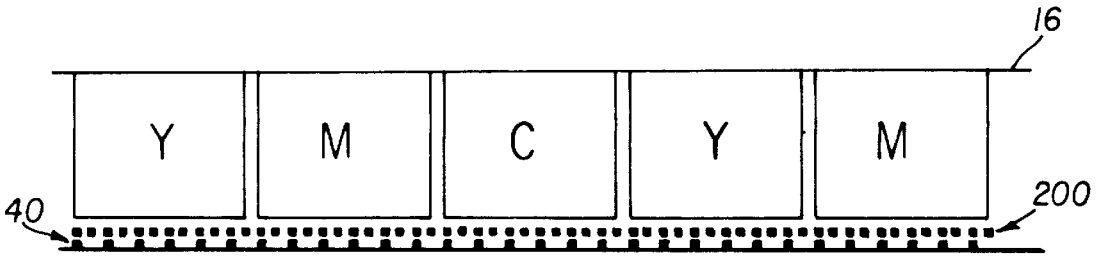

FIG. 16(*a*) shows another embodiment of this invention where dye donor 16 includes a repetitive series of color patches (for example, yellow patch 30, magenta patch 32, and cyan patch 34). A first track of metering marks 40 is provided as before where the distance between metering marks has a uniform spacing. FIG. 16(*b*) shows a plot 44 of the distance between metering marks and the metering mark location. The uniform spacing of this example provides a plot line 44 with no slope. A second metering mark track 200 is also provided on the opposite side of dye donor 16 of FIG. 16(*a*). The distance $F_2$ between adjacent marks in the second track is illustrated at 202. The plot 204 of spacing versus mark location is shown in FIG. 16(*b*). First and second metering mark tracks 40 and 200, respectively, have different distances $F_1$ and $F_2$, respectively. Multiple metering mark tracks provide greater accuracy in measuring distances on dye donor 16. In addition to the concept of using a unique spacing between metering marks of a single metering track to convey donor information, it is now also possible to convey information with both metering tracks.

Additional information can be conveyed using mathematical combinations of information from the two metering mark tracks. For example, addition, subtraction, multiplication, division, logarithms, square roots and other mathematical functions can be performed using the values of the information from the metering mark tracks, as shown below:

$$F_1 + F_2 \quad F_1 - F_2 \quad F_1 * F_2 \quad F_1 / F_2$$

$$F_1 \log(F_2) \quad (F_1)^{F_2} \quad \sin(F_1) + \cos(F_2) \quad \text{et cetera}$$

The multiple metering tracks can be located in a variety of positions on dye donor 16. For example, just a few of the many possibilities are shown in FIG. 17. FIG. 17(*a*) shows two metering mark tracks 40 and 200 on opposite sides of dye donor 16, overlapping the color patches. FIG. 17(*b*) shows the metering mark tracks 40 and 200 located on the same side of dye donor 16. In this case, the metering mark tracks are far enough apart to appear as distinct marks. An alternative is shown in FIG. 17(*c*), where two metering mark tracks 40 and 200 are close enough to touch. It is also possible to have the metering mark tracks 40 and 200 located in opposite borders adjacent to the color patches as shown in FIG. 17(*d*), or they could be located in the same border adjacent to the color patches as portrayed in FIG. 17(*e*). Again, the two metering marks tracks could be separate or touching in this example.

Figure 18A:
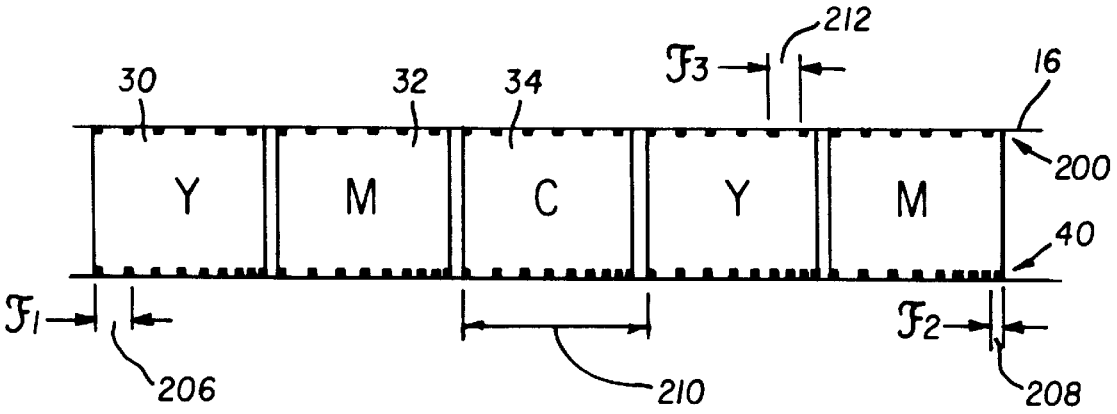
FIGS. 18(*a*) and 18(*b*) show a dye donor with two tracks of metering marks, where the spacing of the marks for one track varies uniformly and the spacing of the marks for the other track varies linearly in a repeating pattern the length of a patch.
Figure 18B:
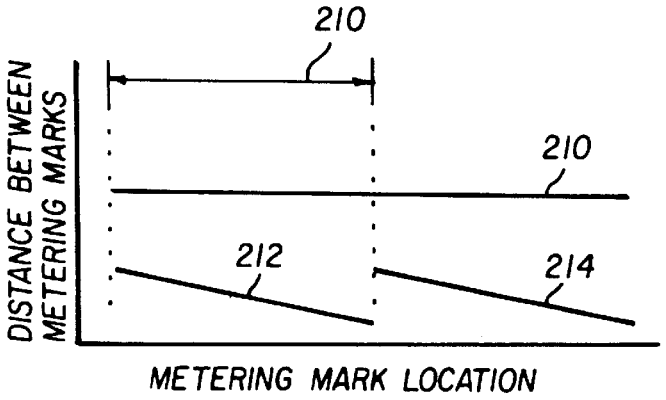

A variation of the embodiment shown in FIG. 16 is shown in FIG. 18(*a*). Here the first metering mark track 40 comprises a repetitive sequence 210 of metering marks. The distance between one pair of adjacent metering marks is different from the spacing of another pair of adjacent metering marks in the same sequence 210. The plot of distance between marks versus mark location for this sequence 210 is shown in FIG. 18(*b*) as a linear plot line 212 with a slope. The plot 214 for the adjacent metering mark sequence for the first metering mark track is also shown.

The second metering mark track 200 has a distance $F_3$ between marks as shown at 212, which distance is different from the first track 40, as shown in the plot 210 in FIG. 18(*b*).

Figure 19:
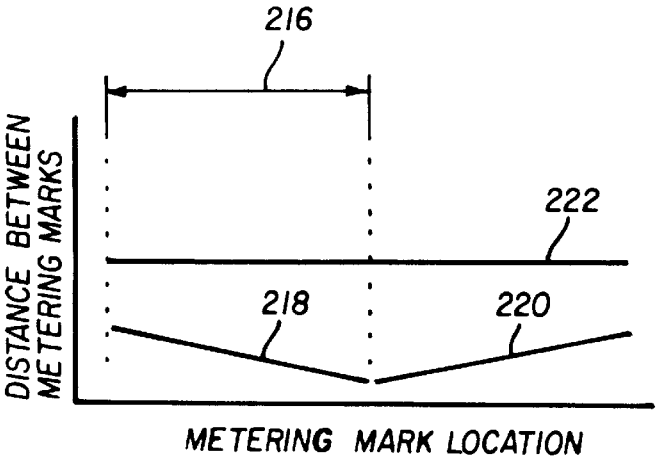
FIG. 19 shows the spacing for two metering mark tracks where one track spacing is uniform and the other includes a repeating pattern in which the sequence of spacing between marks reverses for alternating patches or color groups.

As with the single track embodiments, it is possible to use the slope of the plots to convey information. FIG. 19 shows the plot of distance between marks versus mark location for a first metering track sequence 216 in which a first sequence has a negative slope 218 and an adjacent sequence 220 has a slope of the opposite sign (positive). The second metering mark track's plot 222 is shown as being uniform in this example.

Figure 20A:
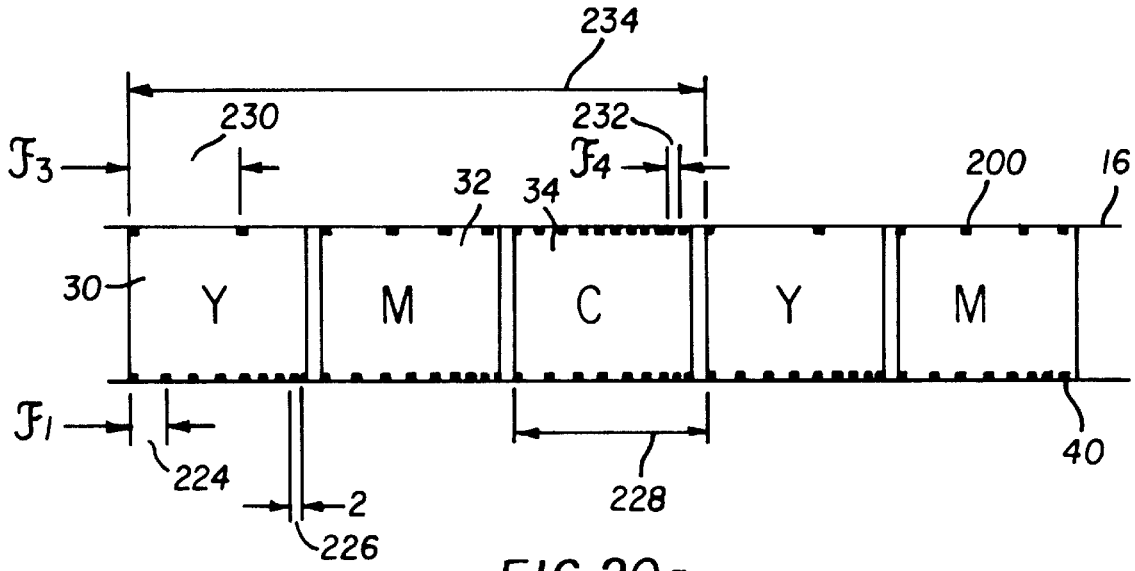
FIGS. 20(*a*) and 20(*b*) show a dye donor with two tracks of metering marks, where the spacing of the marks for one track varies linearly in a repeating pattern the length of a patch and the spacing of the marks for the other track varies linearly in a repeating pattern the length of a color group.
Figure 20B:
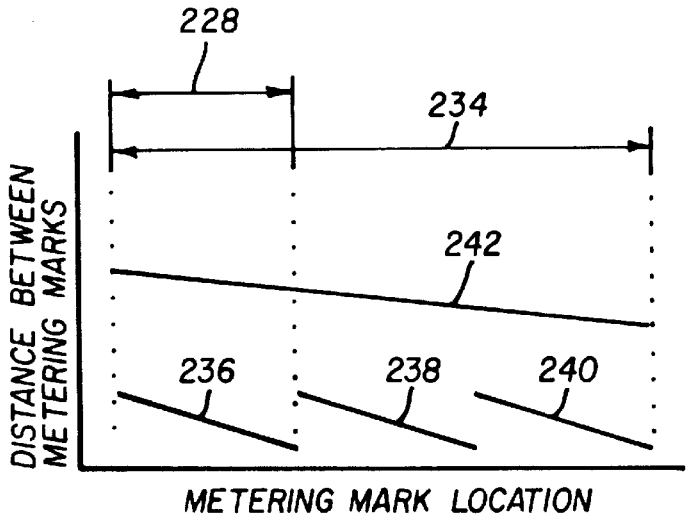

FIG. 20(*a*) shows a dye donor 16 with two metering mark tracks 40 and 200 where both tracks have linearly changing distances between metering marks. As in earlier examples, the first metering mark track 40 has repetitive sequences of metering marks 228 which repeat for each color patch. Plots of the distance between marks versus mark location 236, 238 and 240, are shown in FIG. 20(*b*). The second metering mark track 200 includes a sequence of metering marks 234 which is associated with the size of the color group. This provides a plot 242 of distance between marks versus mark location shown in FIG. 20(*b*). When both metering mark tracks 40 and 200 provide a change from one sequence to the next, information can be conveyed about the dye donor 16. In this case, start or end of color group, as well as start or end of color patch. Although redundant information seems to be conveyed in this example, a variation of this concept provides more utility and will be discussed later.

Figure 21:
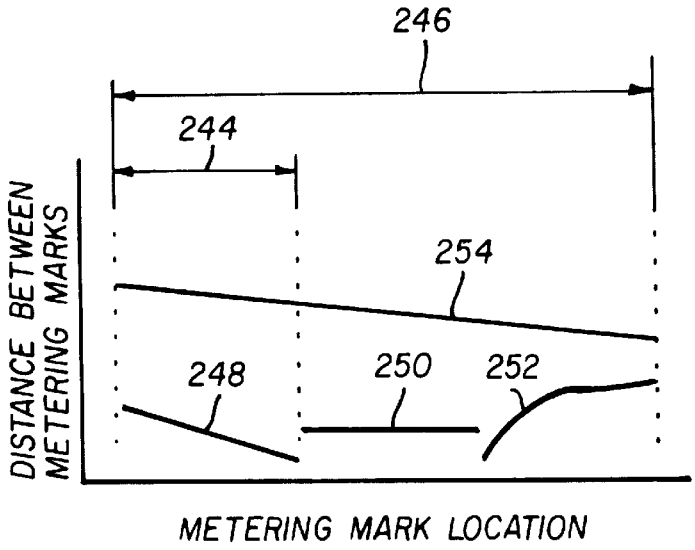
FIG. 21 shows the spacing for two metering mark tracks where one track spacing varies linearly in a repeating pattern the length of a color group and the other track includes a repeating sequence of distinct spacing patterns, each pattern being the length of a patch.

FIG. 21 shows that the sequences used for various patches can all be different. This example combines linear, uniform and nonlinear sequences in two metering mark tracks. Information can be conveyed by the type of sequences chosen for the metering mark track design.

Figure 22A:
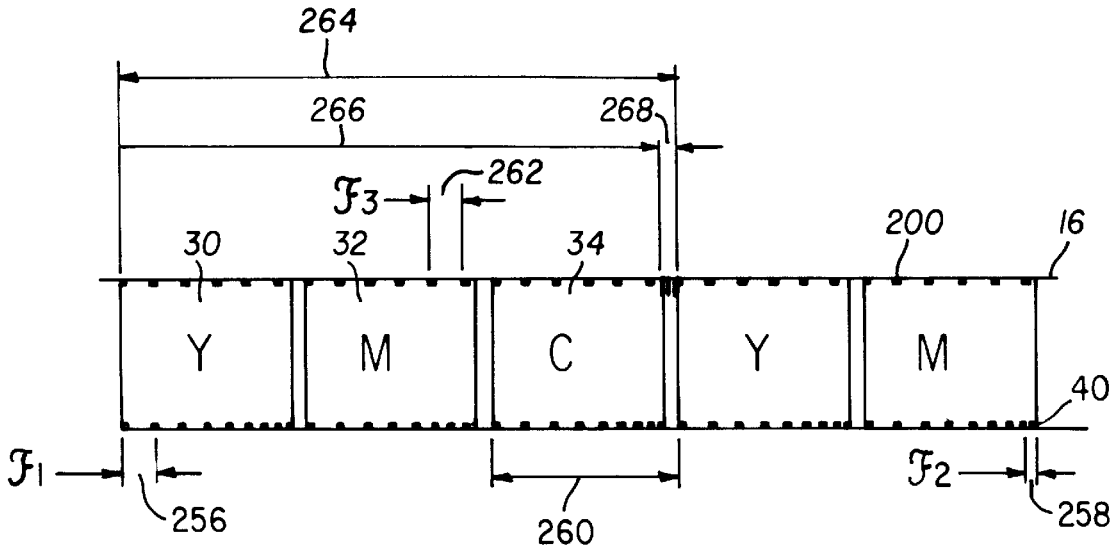
FIGS. 22(*a*) and 22(*b*) show a dye donor with two tracks of metering marks, where at least one track includes a sequence of metering marks comprising more than one sub-sequence of marks, and where the spacing of the marks the various tracks are linear as shown in the plot.
Figure 22B:
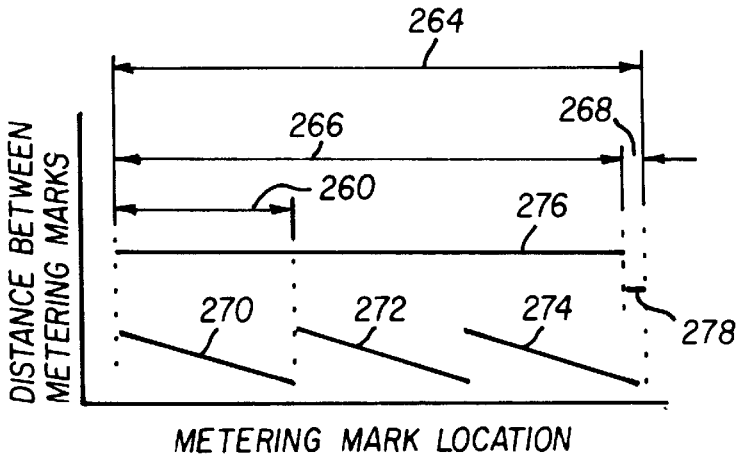

FIG. 22 shows another alternative metering mark track design concept, in which sub-sequences are combined to form a sequence of metering marks. As described in earlier examples, the first metering mark track 40 is formed of repetitive sequences 260 of linearly spaced marks having a plot 270 with a negative slope. The second metering mark track 200 is formed of repetitive sequences 264 of metering marks. These sequences 264 include a first sub-sequence 266 with a distance $F_3$ between metering marks 262 and a second sub-sequence 268 with a distance $F_4$ between metering marks (not shown).

As has been mentioned earlier, metering marks can convey information in addition to accurate position or distance measurement. A wide variety of information known to those skilled in the art can be included in metering mark designs. Examples include media type, media configuration, number of frames, orientation (right/wrong side or direction), quality, color, etc.

The invention has been described in detail with particular reference to preferred embodiments thereof, but it will be understood that variations and modifications can be effected within the spirit and scope of the invention. For example, while this invention has been described using dye donor, it could easily be adapted to use with dye receiver.

What is claimed is:

1. A thermal dye printer media element for use in a thermal printer, comprising:

sequential color patches which form multiple color groups located along a length of said element;

a repetitive sequence of metering marks provided along the length of said element for measurement of distances along said element, wherein said metering mark sequence includes at least two said metering marks, and wherein spacing between said metering marks within a sequence changes; and a first metering mark sequence provided for a first color patch and a second metering mark sequence provided for a second color patch, wherein said first and said second metering mark sequences are different.

2. The thermal dye printer media element of claim 1 wherein the spacing between said metering marks within a sequence changes in a linear fashion.

3. The thermal dye printer media element of claim 1 further including a third sequence of metering marks provided for a third color patch, wherein said third metering mark sequence is different from said first sequence.

4. The thermal dye printer media element of claim 1 wherein the start of a metering mark sequence is aligned with an edge of a color patch.

5. The thermal dye printer media element of claim 1 wherein the metering marks are optically detectable.

6. The thermal dye printer media element of claim 1 whereing the metering marks are magnetically detectable.

* * * * *